US008561970B1

(12) United States Patent
Mills et al.

(10) Patent No.: US 8,561,970 B1
(45) Date of Patent: Oct. 22, 2013

(54) AERATION SYSTEM

(71) Applicant: Brookstone Purchasing, Inc., Merrimack, NH (US)

(72) Inventors: Stephen B. Mills, Atkinson, NH (US); Christopher M. Petersen, Milford, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 0 days.

(21) Appl. No.: 13/748,500

(22) Filed: Jan. 23, 2013

(51) Int. Cl.
*B01F 3/04* (2006.01)

(52) U.S. Cl.
USPC ..... 261/30; 261/74; 261/124; 99/323.1

(58) Field of Classification Search
USPC ..... 261/30, 74, 77, 121.1, 124; 99/323.1; 426/474
See application file for complete search history.

(56) References Cited

U.S. PATENT DOCUMENTS

| | | | | | |
|---|---|---|---|---|---|
| 1,888,503 | A | | 11/1932 | Hoppe | |
| 4,112,829 | A | | 9/1978 | Poinsard et al. | |
| 4,186,215 | A | | 1/1980 | Buchel | |
| 4,475,576 | A | | 10/1984 | Simon | |
| 4,494,452 | A | * | 1/1985 | Barzso | 99/323.1 |
| 4,526,730 | A | | 7/1985 | Cochran et al. | |
| 4,624,391 | A | | 11/1986 | Shannon | |
| 4,711,163 | A | | 12/1987 | Capuano | |
| 4,785,724 | A | * | 11/1988 | Vassallo | 99/323.1 |
| 4,818,444 | A | | 4/1989 | Hedderick et al. | |
| 4,911,212 | A | | 3/1990 | Burton | |
| 4,999,140 | A | | 3/1991 | Sutherland et al. | |
| 5,154,112 | A | * | 10/1992 | Wettern | 99/323.1 |
| 5,235,901 | A | | 8/1993 | MacLennan et al. | |
| 5,365,830 | A | | 11/1994 | MacLennan et al. | |
| 5,406,881 | A | | 4/1995 | Petershans et al. | |
| 5,458,165 | A | * | 10/1995 | Liebmann, Jr. | 141/64 |
| 5,566,730 | A | | 10/1996 | Liebmann, Jr. | |
| 5,595,104 | A | * | 1/1997 | Delaplaine | 99/323.1 |
| 5,635,232 | A | | 6/1997 | Wallace | |
| 5,676,186 | A | | 10/1997 | Vanderploeg | |
| 5,705,211 | A | | 1/1998 | Bedell et al. | |
| 5,713,263 | A | | 2/1998 | Burks, III | |
| 5,758,700 | A | | 6/1998 | Vanderploeg | |
| 5,778,763 | A | | 7/1998 | Ford | |
| 5,931,382 | A | * | 8/1999 | Gross et al. | 239/17 |

(Continued)

FOREIGN PATENT DOCUMENTS

| | | | |
|---|---|---|---|
| WO | 9822571 | A1 | 5/1998 |

*Primary Examiner* — Charles Bushey
(74) *Attorney, Agent, or Firm* — Grossman Tucker Perreault & Pfleger, PLLC

(57) ABSTRACT

An aerator for aerating a liquid within a container having a main body portion and an opening. The aerator includes a pump assembly configured to provide an air flow, a cannulated shaft, and a manifold assembly configured to be fluidly coupled to the pump assembly by way of the cannulated shaft. The manifold assembly is configured to distribute the air flow to a plurality of radially arranged manifold nozzles, wherein the radially arranged manifold nozzles are configured to generate a plurality of air bubbles having a radial velocity configured to direct the plurality of air bubbles radially outward from the manifold assembly such that the plurality of air bubbles travel vertically upwards generally towards the opening of the container without generally contacting the main body portion of the container or the cannulated shaft. For example, the manifold assembly may be configured to generate the plurality of air bubbles having a radial velocity of 2.0 feet/second to 3.0 feet/second.

20 Claims, 12 Drawing Sheets

(56) References Cited

U.S. PATENT DOCUMENTS

| | | | | |
|---|---|---|---|---|
| 5,950,524 | A | 9/1999 | Reitz et al. | |
| 6,332,706 | B1 | 12/2001 | Hall | |
| 6,508,163 | B1 * | 1/2003 | Weatherill | 99/323.1 |
| 6,557,459 | B1 | 5/2003 | Phelps et al. | |
| 6,595,109 | B2 | 7/2003 | Liebmann, Jr. | |
| 6,601,833 | B2 | 8/2003 | Takai et al. | |
| 6,814,992 | B2 | 11/2004 | Pazik et al. | |
| 6,817,281 | B2 | 11/2004 | Gruenewald et al. | |
| 7,022,283 | B2 | 4/2006 | McGuire et al. | |
| 7,107,896 | B1 | 9/2006 | Gaubert | |
| 7,198,074 | B2 | 4/2007 | Lemme et al. | |
| 7,299,743 | B2 | 11/2007 | Moore | |
| 7,726,355 | B2 | 6/2010 | Lemme et al. | |
| 7,850,365 | B1 * | 12/2010 | Much et al. | 366/101 |
| D631,291 | S | 1/2011 | Kushner et al. | |
| 7,963,213 | B1 | 6/2011 | Murdock | |
| 8,196,906 | B2 * | 6/2012 | Benton et al. | 261/110 |
| 8,205,541 | B2 | 6/2012 | Barberio et al. | |
| 8,230,778 | B2 | 7/2012 | Piscaer et al. | |
| 8,337,925 | B2 * | 12/2012 | Carbonini et al. | 426/474 |
| 8,430,023 | B2 | 4/2013 | Hynes | |
| 2003/0214056 | A1 * | 11/2003 | Salter et al. | 261/124 |
| 2008/0276486 | A1 | 11/2008 | Eichholz et al. | |
| 2010/0006592 | A1 | 1/2010 | Maas et al. | |
| 2010/0010422 | A1 | 1/2010 | Watanabe | |
| 2010/0058933 | A1 | 3/2010 | Cheng | |
| 2010/0090355 | A1 * | 4/2010 | Weatherill | 261/26 |
| 2010/0104718 | A1 | 4/2010 | Durand et al. | |
| 2010/0147158 | A1 | 6/2010 | Muller | |
| 2010/0260914 | A1 | 10/2010 | Seta et al. | |
| 2010/0278980 | A1 | 11/2010 | Tomasello et al. | |
| 2011/0005401 | A1 | 1/2011 | Burroughs et al. | |
| 2011/0024461 | A1 | 2/2011 | Kilduff et al. | |
| 2011/0154994 | A1 | 6/2011 | Sabadicci | |
| 2011/0297006 | A1 * | 12/2011 | Belcher | 99/323.1 |

* cited by examiner

AERATION SYSTEM

PRIORITY INFORMATION

N/A

RELATED APPLICATIONS

The instant application is related to U.S. patent application Ser. Nos. 29/437,876, 29/437,886, and 29/437,888, all of which were filed on Nov. 21, 2012, all of which are fully incorporated herein by reference.

FIELD

Embodiments of this invention relate to apparatus for aerating liquid, and more particularly, to an apparatus for aerating wine.

BACKGROUND

Aerating liquids, such as wine and the like, is a common method of improving the taste. Most wines are stored in a relatively oxygen free environment inside its bottle. Aerating wine is a process in which air is mixed into the wine, thereby increasing the exposure of the wine to oxygen and causing aeration. Aerating wine may open up the wine's aromas and cause the flavor profile to soften and mellow out a bit, thereby enhancing the overall flavor characteristics. As may be appreciated, aerating a wine too long may deteriorate the flavor profile, while not aerating long enough may not fully maximize the wine's flavor and bouquet. The amount of time necessary to aerate a wine depends on the age of the wine and the method used.

BRIEF DESCRIPTION OF THE DRAWINGS

Embodiments of the present invention are illustrated by way of example, and not by way of limitation, in the figures of the accompanying drawings and in which like reference numerals refer to similar elements and in which.

DETAILED DESCRIPTION

Examples described below are for illustrative purposes only, and are in no way intended to limit embodiments of the invention. Thus, where examples may be described in detail, or where a list of examples may be provided, it should be understood that the examples are not to be construed as exhaustive, and do not limit embodiments of the invention to the examples described and/or illustrated.

By way of a general overview, one embodiment of the present disclosure is directed to an aerator. As may be appreciated, the aerator is particularly suited for aerating wine; however, the aerator should not be limited to wine unless specifically claimed as such as the aerator may be used to aerate any liquid. The aerator includes a pump assembly, a cannulated shaft, and a manifold assembly. As explained herein, the pump assembly is configured to provide a flow of air through the cannulated shaft to the manifold assembly which distributes the air to a plurality of radially arranged manifold nozzles. Each of the plurality of nozzles is configured to generate a plurality of bubbles having a radial velocity such that the air bubbles travel radially outward from the manifold assembly and vertically upwards generally towards the upper surface of the wine within the container (e.g., wine bottle and/or glass) substantially without touching the cannulated shaft or the sidewall(s) of the main body portion of the container (e.g., a standard 750 ml wine bottle having a bottle width/diameter of 60.3 mm or more). The bubbles transfer oxygen into the wine to increase the wine's exposure to oxygen and open up the wine's aromas and cause the flavor profile to soften and mellow out a bit, thereby enhancing the overall flavor characteristics.

Figure 1:
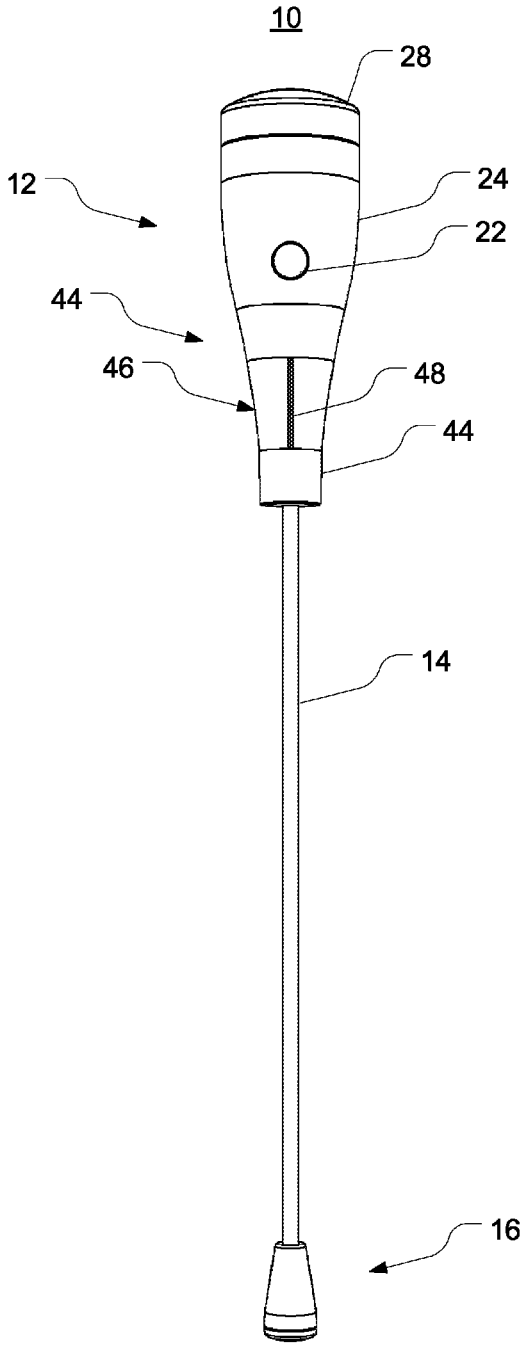
FIG. 1 illustrates a front view of an aerator according to one embodiment.
Figure 2:
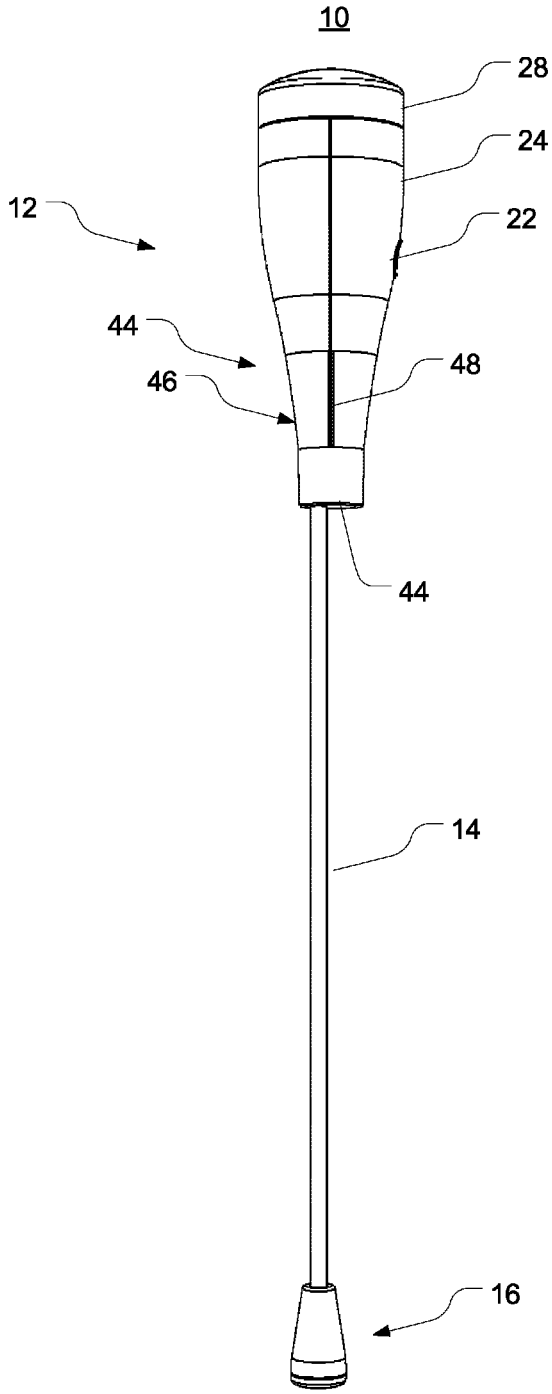
FIG. 2 illustrates a side view of the aerator of FIG. 1.

Turning now to FIGS. 1 and 2, a front and side view of an aerator 10 consistent with at least one embodiment of the present disclosure is generally illustrated. The aerator 10 includes a pump assembly 12, a cannulated shaft 14, and a manifold assembly 16. As explained herein, the pump assembly 12 is configured to provide a flow of air through the cannulated shaft 14 to the manifold assembly 16. The manifold assembly is configured to distribute the air flow to a plurality of manifold apertures at a desired flow rate and pressure to generate air bubbles having a desired diameter and radial exiting velocity.

Figure 3:
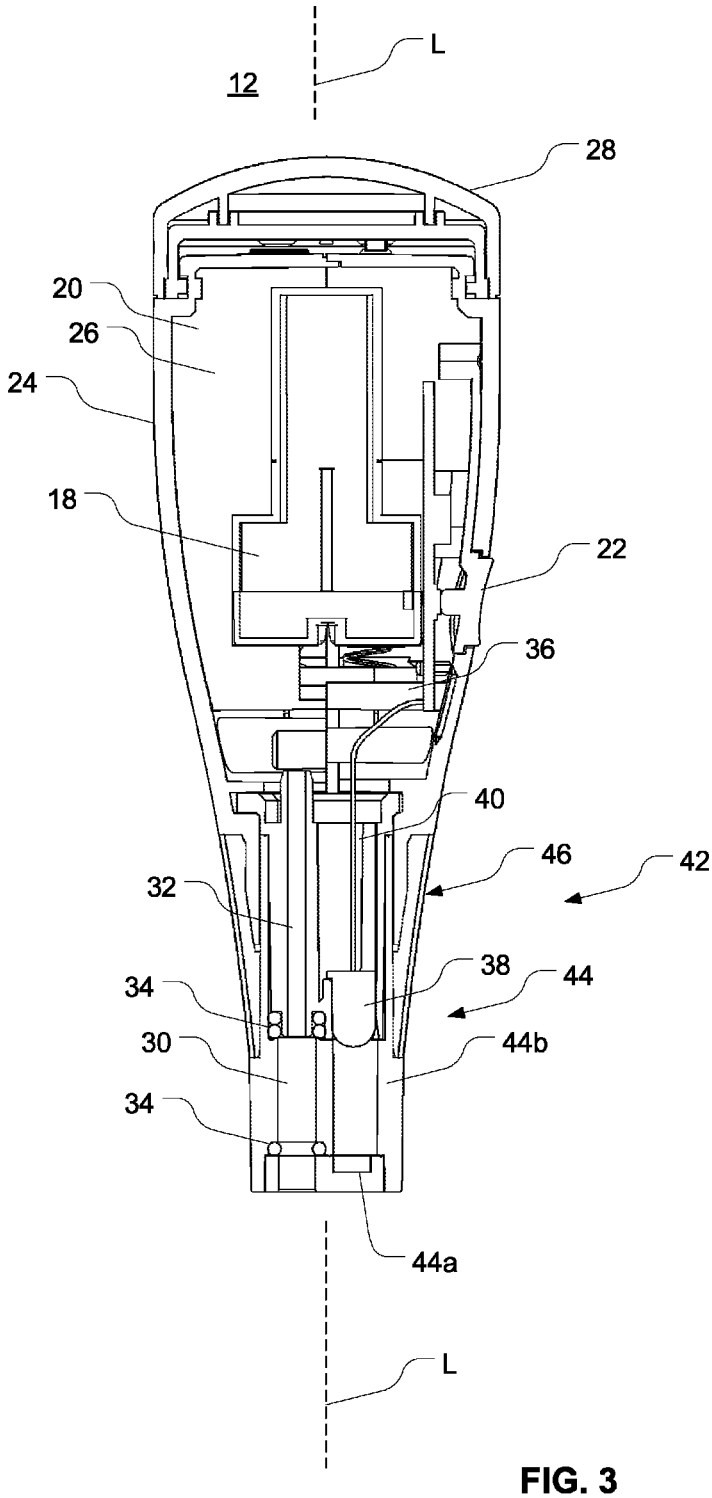
FIG. 3 illustrates a cross-sectional view of a pump assembly according to one embodiment.

With reference to FIG. 3, a cross-sectional view of a pump assembly 12 consistent with one embodiment of the present disclosure is generally illustrated. The pump assembly 12 includes a pump 18, a power source 20, and a power switch 22 at least partially disposed within a housing 24. According to one embodiment, the housing 24 defines a battery compartment 26 configured to receive the power source 20 (such as one or more batteries). The pump assembly 12 may optionally include a cover 28 configured to be removably coupled to the housing 24, for example, to provide access to the battery compartment 26. The power switch 22 may be provided on an external surface of the housing 24 and may be activated by a user to selectively provide power from the power source 20 to the pump 18.

The pump 18 may be fluidly coupled to a shaft cavity 30 defined in the housing 24 by way of one or more air passages 32 to selectively provide a flow of air thereto. The air passage (s) 32 may be integrally formed as part of the housing 24 and/or may include any cannulated lumen (e.g., a flexible or rigid pipe and/or tube). The pump 22 may include any type of pump configured to supply the desired air flow rate and pressure such as, but not limited to, positive displacement pumps, impulse pumps, velocity pumps, and the like, for example, diaphragm pumps, rotary pumps, centrifugal pumps, etc. The pump 22 may be powered by an AC power source and/or a DC power source 20 such as, but not limited to, one or more batteries, AC plug, AC/DC converter, or the like. According to one embodiment, the pump assembly 12 may include at least one rechargeable battery which may be recharged using an onboard and/or remote AC/DC converter.

The shaft cavity 30 is configured to receive and retain a proximal end of the cannulated shaft 14 (not shown in FIG. 3 for clarity) such that the air flow from the pump 22 flows through the cannulated shaft 14 to the manifold assembly 16. According to one embodiment, the shaft cavity 30 and the cannulated shaft 14 are configured to be removably coupled to each other. This arrangement may provide numerous benefits. For example, one benefit of removably coupling the pump assembly 12 to the cannulated shaft 14 is that it allows the cannulated shaft 14 and manifold assembly 16 to be cleaned. As may be appreciated, wine may flow into the cannulated shaft 14 and manifold assembly 16 after the air flow from the pump assembly 12 has stopped providing the flow of air. Therefore, being able to disconnect the cannulated shaft 14 and manifold assembly 16 from the pump assembly 12 may allow the cannulated shaft 14 and manifold assembly 16 to be easily cleaned. Another benefit of removably coupling the pump assembly 12 and the cannulated shaft 14 is that it allows the pump assembly 12 to be coupled to different cannulated shafts 14 (e.g., having different lengths and/or diameters) as well as different manifold assemblies 16 (for example, the size, number, and/or orientation of the manifold apertures and/or the manifold volume). By varying the configuration of the cannulated shaft 14 and/or the design of the manifold assembly 16, the aerator 10 may be used to aerate different size wine bottles as well as aerating wine in a drinking glass or the like.

The shaft cavity 30 may optionally include one or more sealing members 34 (e.g., o-rings or the like). The sealing members 34 are configured to generally seal the cannulated shaft 14 to the shaft cavity 30 to minimize any air leakage therebetween. The shaft cavity 30 may also optionally include a taper (e.g., a conical taper) configured to form an interference connection with a corresponding taper (e.g., conical taper) of the proximal end of the cannulated shaft 14. Such an arrangement may aid in securing the cannulated shaft 14 to the pump assembly 12 while also allowing the cannulated shaft 14 to be easily removed from the pump assembly 12. Additionally (or alternatively), the shaft cavity 30 and/or the proximal end of the cannulated shaft 14 may include one or more locking features (such as a tap/slot/groove arrangement) configured to aid in securing the shaft cavity 30 and the proximal end of the cannulated shaft 14. For example, the proximal end of the cannulated shaft 14 may feature a protrusion or tab which extends outwardly from a portion of the cannulated shaft 14. The protrusion may be configured to be received in a slot/groove formed in the shaft cavity 30. The protrusion may be advanced into the slot within the shaft cavity 30 and then rotated to secured/lock the cannulated shaft 14 within the shaft cavity 30. As may be appreciated, other locking arrangements are possible for removably coupling the pump assembly 12 and the cannulated shaft 14. Additionally, it will be appreciated that the cannulated shaft 14 may be permanently secured and sealed to the pump assembly 12. As such, the shaft cavity 30 may optionally be eliminated.

The pump assembly 12 may optionally include circuitry 36. Circuitry 36 (which may include one or more printed circuit boards) may be configured to regulate power provided to the pump 18 by controlling the voltage of the power supplied to the pump 18 and/or the length of time that the pump 18 operates. For example, upon activation of the power switch 22, the circuitry 36 may provide power from the power source 20 to the pump 18 for a predetermined time. The predetermined amount of time may be selected to achieve an optimal enhancement of the overall flavor characteristics and aromas of the wine and is based on the flow rate of the pump 18, the bubble size, and the resulting amount of oxygen transferred. The circuitry 36 may therefore function as a timer in the sense that it allows the pump 18 to operate for a predetermined amount of time upon selecting the power switch 22. Predetermined time intervals may be, for example, thirty seconds, sixty seconds, and the like.

In a further optional embodiment, circuitry 36 may also be configured to recognize the length of the cannulated shaft 14 and/or the design of the manifold assembly 16 to change the timer length. For example, the cannulated shaft 14 and/or the manifold assembly 16 may include a bar code (or the like), a radio frequency identifier (RFID), or the like that may be in communication with (e.g., read by) the circuitry 36. The circuitry 36 may therefore select the appropriate timer length. Alternatively, the pump assembly 12 may include one or more inputs (such as, but not limited to, the power switch 22) which may be configured to provide a signal to the circuitry 36 to select the timer length. For example, the power switch 22 may be repeatedly depressed to scroll through a plurality of predetermined timer lengths stored in the circuitry 36. Optionally, a display (not shown for clarity) may be included to provide a visual indication of the selected timer length. Other configurations for selecting a timer length using the circuitry 36 are also possible.

The pump assembly 12 may optionally include one or more light sources 38 configured to provide a source of light to illuminate a portion of the pump assembly, the wine bottle, the wine glass, and/or the wine therein. The illumination allows the user to see the aeration at work and also provides an aesthetically pleasing appearance. The light source 38 may include any semiconductor light source such as, but not limited to, conventional high-brightness semiconductor light emitting diodes (LEDs), organic light emitting diodes (OLEDs), bi-color LEDs, tri-color LEDs, polymer light-emitting diodes (PLED), electro-luminescent strips (EL), etc. The LEDs may include, but are not limited to, packaged and non-packaged LEDs, chip-on-board LEDs, as well as surface mount LEDs. The LEDs may also include LEDs with phosphor or the like for converting energy emitted from the LED to a different wavelength of light. The LEDs may be simultaneously and/or independently controlled, for example, to adjust the overall color emitted from the light source 38 and/or compensate for changes in the output of the LEDs, for example, due to age, temperature, and the like as described herein.

The light source 38 is configured to receive power from the power source 20. For example, upon depressing the power switch 22, the circuitry 36 generates a DC signal at a desired current and voltage to power the light source 38, which may be transmitted across an electrical connector 40, such as a flexible wire, rigid wire, or the like. Optionally, the circuitry 36 may control various attributes of the light source 38, for example, the brightness (e.g., a dimmer circuitry) of the LEDs, color of the light emitted from the light source 38 (e.g., the light source 38 may include two or more LEDs configured to emit light having different wavelengths, wherein the circuitry 36 may adjust the relative brightness of the different LEDs in order to change the mixed color from the light source 38), adjust for changes in ambient lighting conditions (e.g., an ambient light sensor), adjust for temperature changes, adjust for changes in output due to lifetime changes, and the like.

The light source 38 may be coupled to the housing 24, for example, proximate to the shaft cavity 30 (e.g., proximate to the distal region 42 of the housing 24). As described herein, the distal region 42 of the pump assembly 12 may be inserted into the opening of a container, such as a wine bottle. The cross-section of the distal region 42, therefore, needs to fit within the wine bottle opening. In one embodiment, the shaft cavity 30 is offset relative to the longitudinal axis L of the housing 24 (e.g., the centerline of the pump assembly 12). Offsetting the shaft cavity 30 relative to the longitudinal axis L allows the light source 38 (e.g. a LED) to be aligned within the housing 24 to provide a downward illumination pattern while also minimizing the cross-sectional shape of the pump assembly 12 proximate to the distal region 42, thereby allowing the pump assembly to be inserted into a wine bottle opening.

The pump assembly 12 may optionally include one or more lenses, diffusers, or the like 44. The lens or diffuser 44 is configured to create a desired illumination pattern. According to one embodiment, the lens/diffuser 44 includes an optical lens/diffuser 44*a* which is secured to a distal end of the housing 24. Alternatively (or in addition), the lens/diffuser 44 may be integral to the housing 24. For example, the lens/diffuser 44*b* may include a portion of the housing 24 which defines the shaft cavity 30.

As discussed herein, the pump assembly 12 may be configured to be received in an opening of a container, such as a wine bottle. The pump assembly 12 may optionally include a tapered surface 46 configured to be received in the opening. The tapered surface 46 allows the pump assembly to be inserted into a variety of openings having different diameters. The tapered surface 46 may optionally include a flexible and/or resilient material. For example, the tapered surface 46 may include a rubber material. The tapered surface 46 also may include one or more flutes or air release grooves 48 (best seen in FIGS. 1 and 2). The flutes 48 run generally longitudinally along the tapered surface 46 and allow the air that is released from the liquid (e.g., wine) by the aerator 10 to be released from the container, thereby preventing pressurization within the container (which could force the pump assembly 12 to become loose within the bottle opening).

With reference back to FIGS. 1 and 2, the cannulated shaft 14 is configured to establish a fluid pathway between the pump assembly 12 and the manifold assembly 16. The cannulated shaft 14 may include different lengths and/or diameters based on intended use. For example, the length and/or diameter of the cannulated shaft 14 may be selected based on the flow rate and pressure of the pump assembly 12 as well as the length and/or diameter of the intend container (e.g., wine bottles and/or glasses). The cannulated shaft 14 may optionally include a tapered first (e.g., proximal) end configured to engage with the shaft cavity 30 of the pump assembly 12. The cannulated shaft 14 may also optionally include a tapered second (e.g., distal) end configured to engage with the manifold assembly 16. The cannulated shaft 14 is preferably constructed from a material with is substantially inert with the intended fluid to be aerated (e.g., wine), and may include, but is not limited to, stainless steel or plastic.

Figure 4:
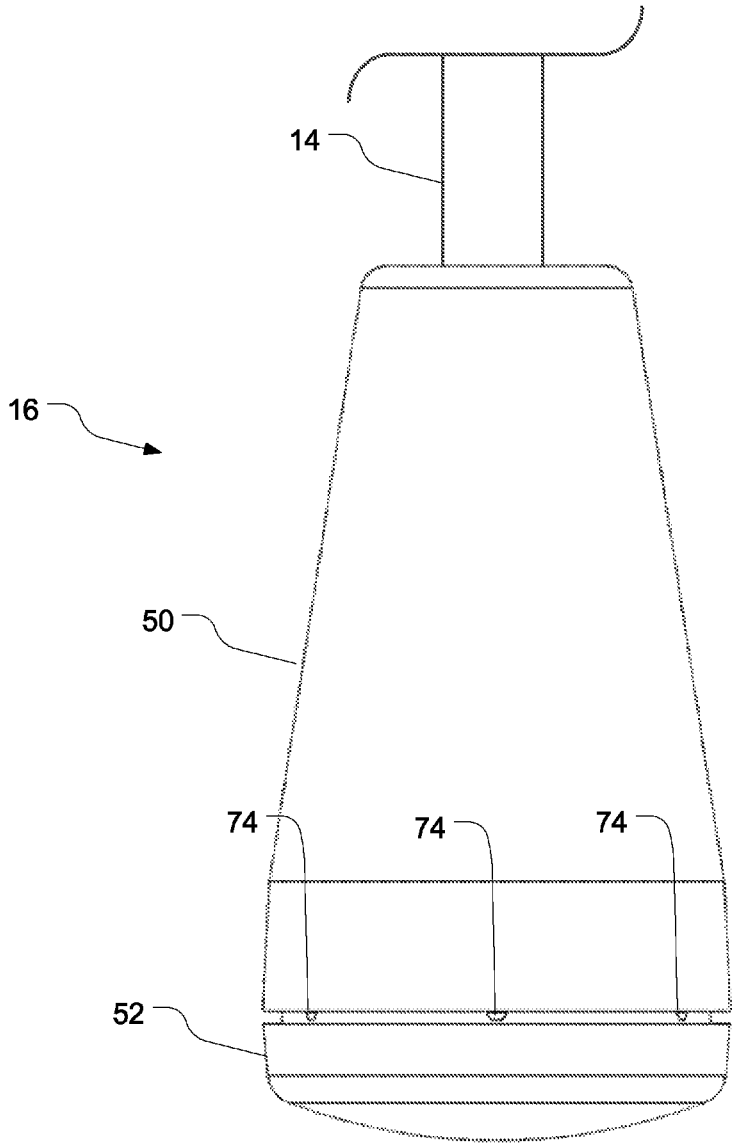
FIG. 4 illustrates a side view of a manifold assembly according to one embodiment.
Figure 5:
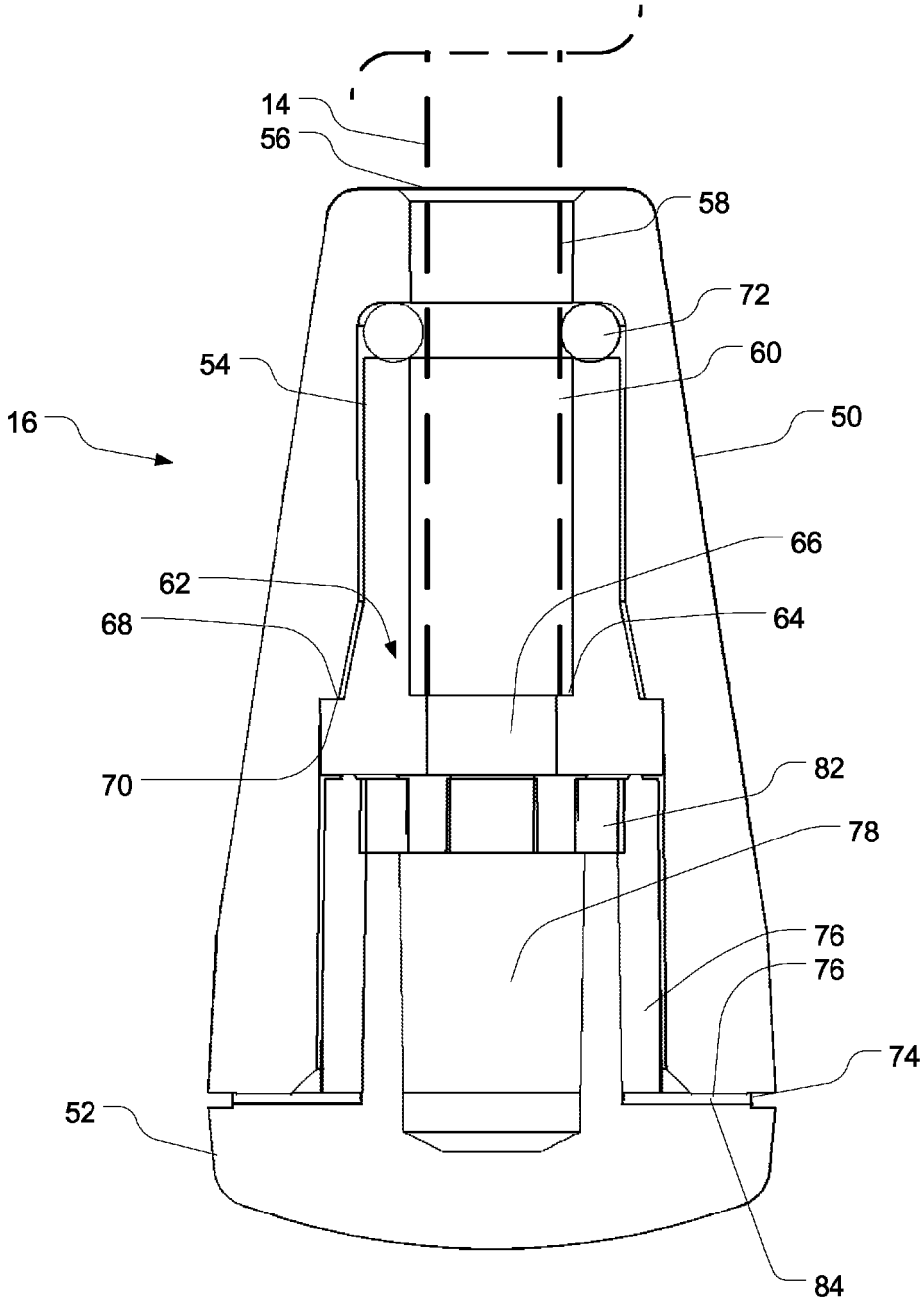
FIG. 5 illustrates a cross-sectional view of the manifold assembly of FIG. 4.
Figure 6:
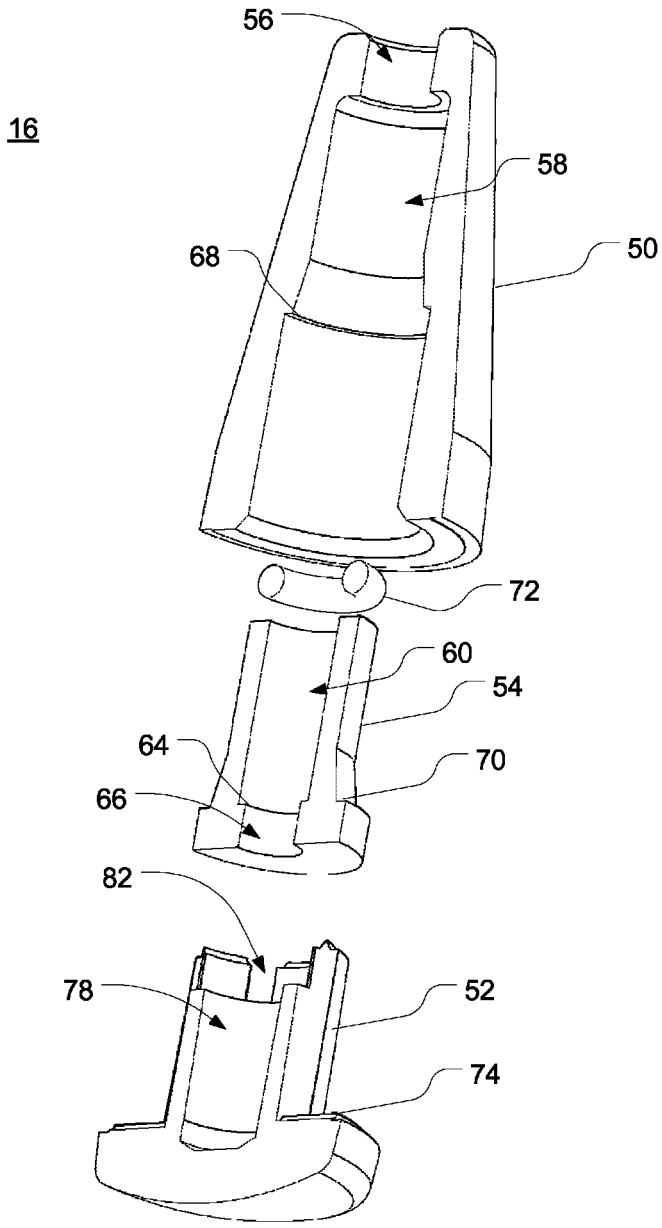
FIG. 6 illustrates an exploded view of the manifold assembly of FIG. 4.

Turning now to FIGS. 4-6, a side plan view, a cross-sectional view, and an exploded view of a manifold assembly 16 consistent with one embodiment of the present disclosure is generally illustrated. The manifold assembly 16 is configured to be fluidly coupled to the cannulated shaft 14 and generate a plurality of air bubbles as described herein. The manifold assembly 16 includes a plenum 50, a manifold 52, and optionally a ferrule 54.

With reference to FIG. 5, the cannulated shaft 14 may be advanced through an opening 56 in a passageway/cavity 58 of the plenum 50 and a passageway 60 within the ferrule 54 until the distal end 62 of the cannulated shaft 14 abuts against a first shoulder region 64 of the ferrule 54. The first shoulder region 64 of the ferrule 54 extends radially inwardly and the ferrule 54 defines an opening 66 fluidly coupling the distal end 62 of the cannulated shaft 14 to the manifold 52. The passageway/cavity 58 of the plenum 50 is configured to receive the ferrule 54 therein and optionally includes a shoulder region 68 configured to engage with (e.g., against) a second shoulder region 70 of the ferrule 54 which extends radially outward. As described herein, the manifold 52 may be configured to be coupled to the plenum 50 and apply a force urging the shoulder region 68 of the plenum 50 against the second shoulder region 70 of the ferrule 54, thereby securing the ferrule 54 within the cavity 60 of the plenum 50. Optionally, one or more seals 72 (e.g., an o-ring or the like) may be provided to seal the plenum 50 and/or the ferrule 54 to the cannulated shaft 14.

The cannulated shaft 14 may be configured to be removably coupled to the manifold assembly 16, for example, using a tapered interference connection or the like. For example, at least a portion of the passageway/cavity 60 defined by the ferrule 54 includes a taper substantially corresponding to the taper of the distal end 62 of the cannulated shaft 14. The ferrule 54 may also form a clamp (e.g., a circular clamp) which may be crimped, swaged, or other deformed to secure the cannulated shaft 14 to the manifold assembly 16. The manifold assembly 16 may also be permanently coupled to the cannulated shaft 14.

As discussed herein, the manifold 52 is configured to receive a flow of air through the cannulated shaft 14 from the pump assembly 12 and distribute the air flow to a plurality of manifold apertures/nozzles 74 at a desired flow rate and pressure to generate air bubbles having a predetermined diameter, flow rate, pressure, and/or radial velocity to aerate the liquid (e.g., wine). The radial velocity of the air bubbles is selected to ensure that the air bubbles substantially do not adhere to the manifold assembly 16, the cannulated shaft 14 and/or the sidewalls of the main body portion of the container (e.g., wine bottle or glass). Some incidental contact of the air bubbles with the cannulated shaft 14, manifold assembly 16, and/or sidewalls of the main portion of the container may be considered within the scope of the present invention. While not a limitation unless specifically claimed as such, the phrase "substantially without touching the cannulated shaft or the sidewall(s) of the main body portion" means that 90% or more of the air bubbles do not touch the cannulated shaft or the sidewall(s) of the main body portion. As may be appreciated, the amount of oxygen transferred into the wine may be reduced if the air bubbles adhere to the manifold assembly 16, the cannulated shaft 14 and/or the sidewalls of the container. Additionally, air bubble adhered to the sidewalls of the main body portion of the container may create an aesthetically unpleasing appearance. Additionally, the size of the air bubbles should be selected to increase the oxygen transfer into the wine and may be selected based on the air flow rate, air pressure, and number of manifold apertures/nozzles.

Figure 7:
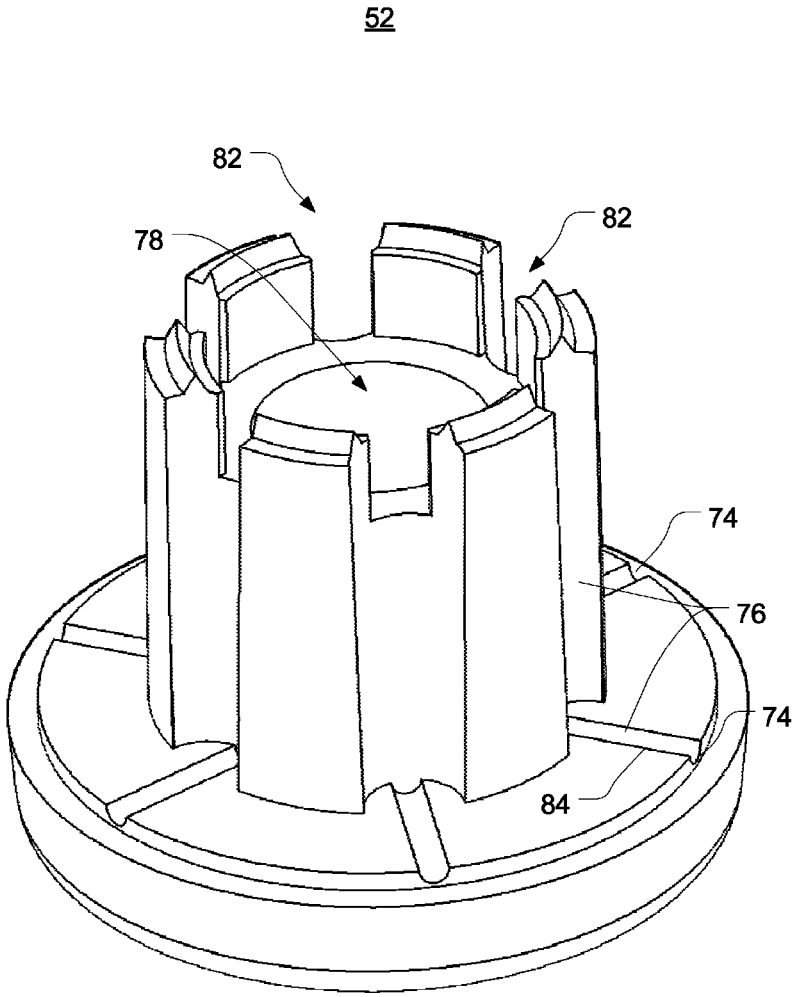
FIG. 7 illustrates a perspective view of a manifold according to one embodiment.

Again, with reference to FIGS. 5-7, the manifold 52 includes a plurality of intake runners 76 (e.g., slots), extending outwardly from one or more intake chambers 78, which terminate at the manifold apertures/nozzles 74. Turning specifically to FIG. 5, the manifold 52 is mounted, coupled, or otherwise secured to the plenum 50. For example, the manifold 52 may be secured to the plenum 50 using one or more threaded connections, adhesive connections, welded connections (e.g., ultrasonic welding or the like), interference connections, mechanical connections, or the like. When secured to the plenum 50, the manifold 52 applies a force against the ferrule 54 (e.g., abuts against) thereby urging the second shoulder region 68 of the ferrule 54 against the shoulder region 70 of the plenum 50 and securing the position of the ferrule 54 within the cavity 58 of the plenum 50.

Figure 8:
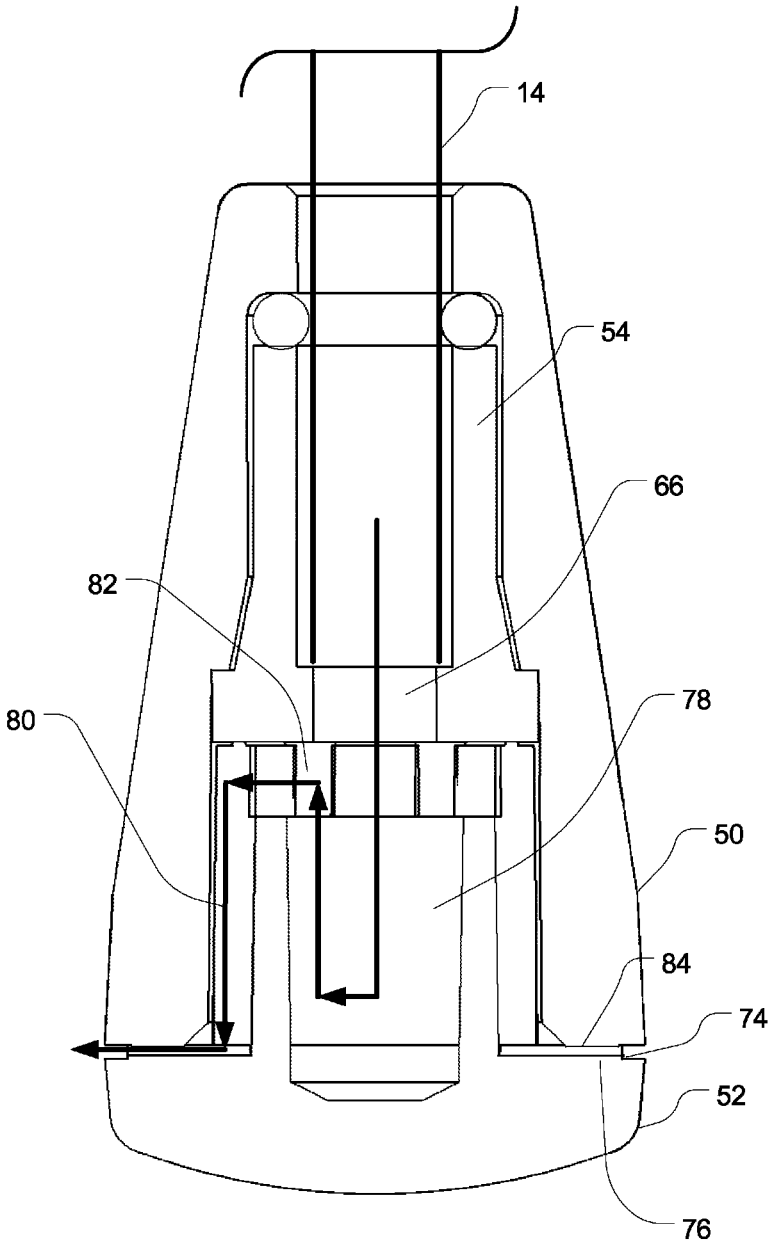
FIG. 8 is a cross-sectional view illustrating an air flow pathway according to one embodiment.

The manifold 52 and/or the plenum 50 define a plurality of intake runners 76 and the manifold 52 and/or the ferrule 54 define the intake chamber 78. Turning now to FIG. 8, an exemplary fluid pathway 80 defined by the intake runners 76 and the intake chamber 78 is generally illustrated. In particular, air from the pump assembly 12 (not shown for clarity) flows through the cannulated shaft 14, through the opening 66 in the ferrule 54, and into the intake chamber 78 defined by the manifold 52 and the ferrule 54. Air within the intake chamber 78 then flows through a plurality of openings 82 (see also FIGS. 5 and 7) into the plurality of intake runners 76. The openings 82 may be arranged about a periphery of the manifold 52 about the proximal/top end of the manifold 52 and may be partially defined by a bottom surface of the ferrule 54. The intake runners 76 may extend generally longitudinally from the openings 82 towards a distal/bottom end of the manifold 52. A portion 84 of the intake runners 76 may also extend generally radially outward and terminates at the manifold apertures/nozzles 74 which are aligned facing generally radially outward. The manifold apertures/nozzles 74 may have a semi-circular cross-section (e.g., a half-circular cross-section), a circular cross-section, an oval cross-section, an oblong cross-section, rectangular cross-section, square cross-section, or the like.

Figure 9:
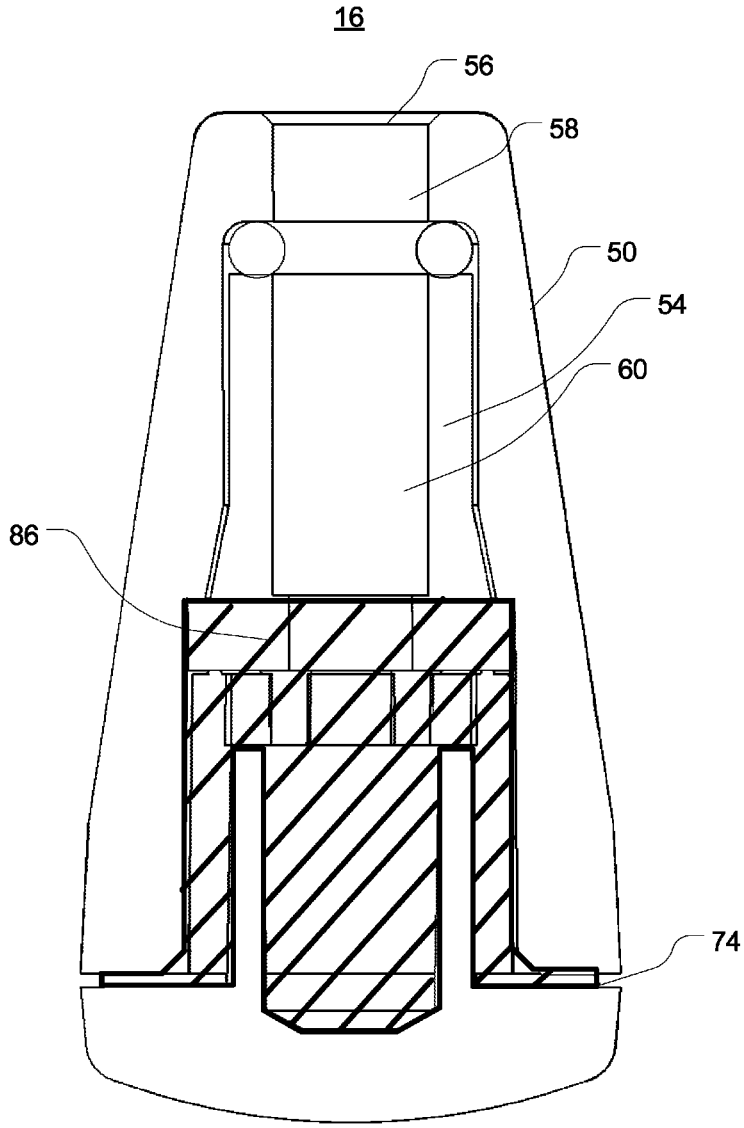
FIG. 9 is a cross-sectional view illustrating a manifold volume according to one embodiment.

The manifold assembly 16 is configured to generate a plurality of air bubbles from the radially arranged manifold aperture/nozzles 74. In particular, the volume of the plurality of intake runners 76 and the intake chamber 78, as well as the position of the radially arranged manifold aperture/nozzles 74, is selected for a specific air flow rate and position of the bubbles as the bubbles exit the radially arranged manifold aperture/nozzles 74. Turning to FIG. 9, the volume of the plurality of intake runners 76 and the intake chamber 78 is generally illustrated by cross-hatching. As may be seen, the volume of the plurality of intake runners 76 and the intake chamber 78 is determined when the plenum 50 and the manifold 52 (as well as the ferrule 54) are assembled and is based on the air flow rate from the pump assembly 12, the desired radial velocity of the bubbles exiting the manifold apertures/nozzles 74, as well as the desired number of radially arranged manifold apertures/nozzles 74.

The radial velocity of the bubbles exiting the manifold apertures/nozzles 74 is selected such that the bubbles generally do not substantially adhere to the aerator 10 or the main body portion of the fluid container (e.g., wine bottle or wine glass). The radial velocity of the bubbles is therefore based on a number of factors including the air flow rate, the number of manifold apertures/nozzles 74, the manifold apertures/nozzle pressure, as well as the desired maximum radial travel distance. As may be appreciated, a bubble exiting the manifold apertures/nozzles 74 will travel radially outward and, due to the buoyancy of the air bubble, will also have a vertical velocity. After the bubble exits the manifold apertures/nozzles 74, the radial velocity will begin to decrease and the bubble will begin to travel substantially only vertically towards the surface of the liquid. The term "maximum radial travel distance" is therefore intended to refer to the maximum radial distance which a bubble travels after exiting the manifold apertures/nozzles 74.

Testing has found that for a manifold assembly 16 having a total volume of between 250 $mm^3$ to 380 $mm^3$ (e.g., 320 $mm^3$), six manifold apertures/nozzles 74 having a half-circular cross-section having a radius between 0.0254 mm to 0.382 mm (e.g., 0.318 mm), a radial velocity of between 2.0 feet/second to 3.0 feet/second (e.g., 2.57 feet/second), a maximum radial travel distance of greater than 1 mm (e.g., between 1 mm to 20 mm, between 2 mm and 8 mm, between 2 mm and 5 mm, between 3 mm and 5 mm, between 1 mm and 3 mm, including all values and ranges therein), a manifold apertures/nozzle pressure of 0.1300 psi to 0.2100 psi (e.g., 0.1792 psi), and an overall flow rate of 240 $centimeter^3$/minute to 360 $centimeter^3$/minute (e.g., 300 $centimeter^3$/minute) works over a wide range of wine bottles and wine glasses and provides enough oxygen transfer during a 30 second operation time (i.e., run time) to open up the wine's aromas and cause the flavor profile to soften and mellow out a bit, thereby enhancing the overall flavor characteristics.

Figure 10:
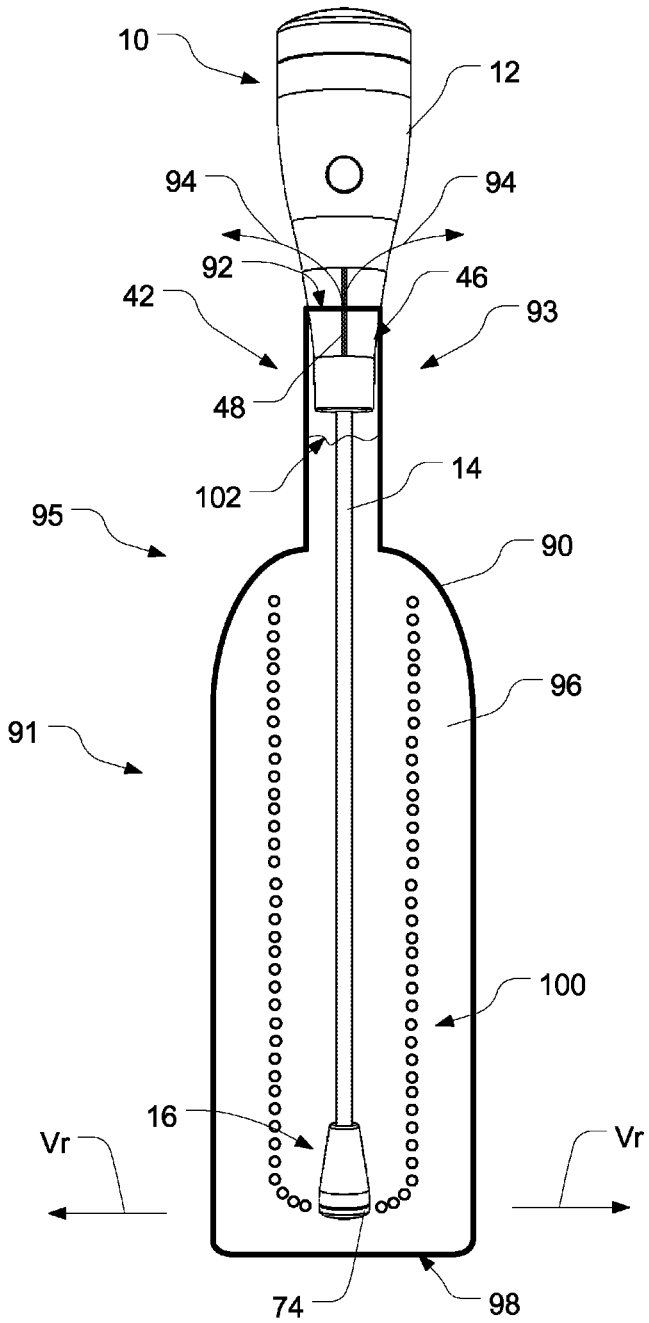
FIG. 10 illustrates the aerator and a bottle according one embodiment.

Turning now to FIG. 10, a side view of the aerator 10 in combination with a wine bottle 90 consistent with one embodiment of the present disclosure is generally illustrated. The wine bottle 90 features a main body portion 91 having a substantially constant diameter, a neck portion 93 having a smaller diameter than the main body portion 91, and a transition portion 95 which is defined as the region of the wine bottle 90 between the main body portion 91 and the neck portion 93 during which the diameter of the wine bottle 90 decreases. For example, the wine bottle 90 may include a standard 750 ml wine bottle. The term "standard 750 ml wine bottle" is intended to refer to a wine bottle including a main body portion 91 having a width/diameter of 60.3 mm or more, such as, but not limited to, 70 mm to 88 mm, or the like.

The pump assembly 12 is configured such that at least a portion of the tapered surface 46 of the distal region 42 fits within (i.e., rests against and is supported by) the opening 92 of the wine bottle 90 in the neck portion 93. The air flutes 48 allow air 94 which is not absorbed into the wine 96 to exit through the opening 92 in the wine bottle 90 and past the pump assembly 12 seated therein. The cannulated shaft 14 is selected such that the manifold assembly 16 is arranged proximate to the bottom 98 of the main body portion 91 of the wine bottle 90. Streams of air bubbles 100 exit the plurality of manifold apertures/nozzles 74 having a radial velocity generally indicated by arrow Vr. The air bubbles 100 travel vertically towards transition portion 95 and the neck portion 93, and ultimately exit the liquid surface 102. It is possible that some of the air bubbles 100 may contact the transition portion 95 and/or the neck portion 93 of the wine bottle 90; however, this is acceptable since most of the oxygen transfer into the wine 94 will have already occurred. Additionally, any air bubbles adhered to the neck portion 93 and/or the transition portion 95 will typically be released after the first glass of wine is poured.

Figure 11:
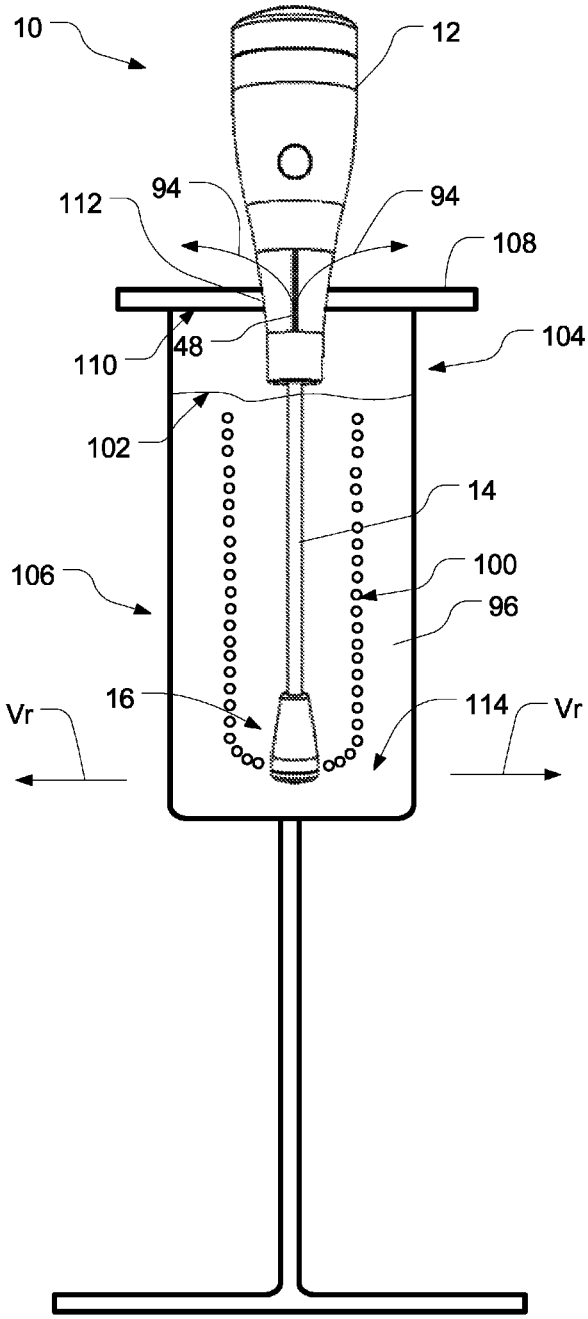
FIG. 11 illustrates the aerator and a glass according one embodiment.

Turning now to FIG. 11, a side view of the aerator 10 in combination with a wine glass 104 consistent with one embodiment of the present disclosure is generally illustrated. The wine glass 104 features a main body portion 106 having a substantially constant diameter, however, it should be appreciated that the wine glass 104 may optionally include a neck portion having a smaller diameter than the main body portion 106, and/or a transition portion which is defined as the region of the wine glass 104 between the main body portion 106 and the neck portion during which the diameter of the wine glass 104 decreases. Optionally, a support substrate 108 is provided which extends across/beyond the top/opening of the wine glass 104. The support substrate 108 includes an opening 112 configured to receive at least a portion of the tapered surface 46 of the distal region 42 of the pump assembly 12. The air flutes 48 allow air 94 which is not absorbed into the wine 96 to exit through the opening 110 in the support substrate 108 and past the pump assembly 12 seated therein. The cannulated shaft 14 is selected such that the manifold assembly 16 is arranged proximate to the bottom 114 of the main body portion 106 of the wine glass 104. As may be appreciated, the cannulated shaft 14 may have a smaller length compared to the cannulated shaft 14 used with the wine bottle 90 (FIG. 10) due to the difference in overall height of the main body portions 91, 106. Streams of air bubbles 100 exit the plurality of manifold apertures/nozzles 74 having a radial velocity generally indicated by arrow Vr. The air bubbles 100 travel vertically towards the liquid surface 102. Again, it is possible that some of the air bubbles 100 may contact the transition portion and/or the neck portion of the wine glass 104 (if present), however this is acceptable since most of the oxygen transfer into the wine 94 will have already occurred. Additionally, any air bubbles adhered to the neck portion and/or the transition portion will typically be released after the first sip of wine is taken by the user.

Figure 12:
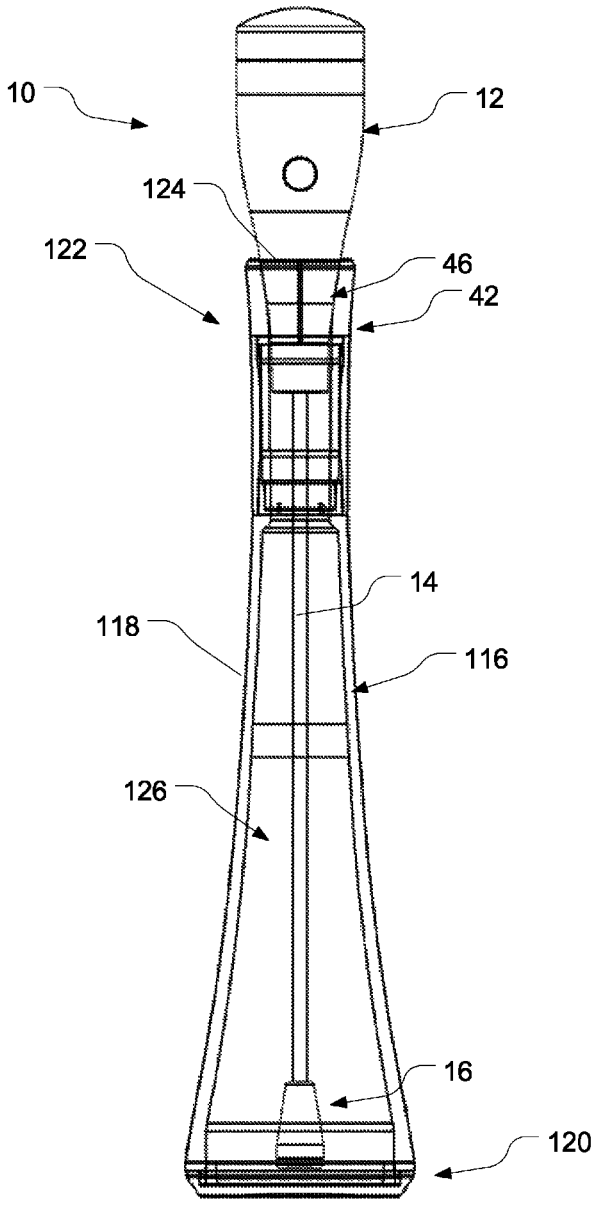
FIG. 12 illustrates the aerator and a holder according one embodiment.

With reference to FIG. 12, a side view of the aerator 10 in combination with a holder 116 consistent with one embodiment of the present disclosure is generally illustrated. The holder 116 features a body 118 extending generally upwardly from a base 120 and a top 122 having an opening 124 configured to receive at least a portion of the tapered surface 46 of the distal region 42 of the pump assembly 12. The body 118 defines a cavity 126 configured to receive a portion of the pump assembly 12, the cannulated shaft 14, and the manifold assembly 16 when the pump assembly 12 is supported within the opening 124. The body 118 is selected to have length such that the cannulated shaft 14 and the manifold assembly 16 fit within the cavity 126.

According to one aspect, the present disclosure features an aerator for aerating a liquid within a container having a main body portion and an opening. The aerator includes a pump assembly configured to provide an air flow, a cannulated shaft, and a manifold assembly configured to be fluidly coupled to the pump assembly by way of the cannulated shaft. The manifold assembly is configured to distribute the air flow to a plurality of radially arranged manifold nozzles, wherein the radially arranged manifold nozzles are configured to generate a plurality of air bubbles having a radial velocity configured to direct the plurality of air bubbles radially outward from the manifold assembly such that the plurality of air bubbles travel vertically upwards generally towards the opening of the container without generally contacting the main body portion of the container or the cannulated shaft. For example, the manifold assembly may be configured to generate the plurality of air bubbles having a radial velocity of 2.0 feet/second to 3.0 feet/second.

According to another aspect, the present disclosure features an aerator for aerating a liquid within a container having a main body portion and an opening. The aerator includes a pump assembly, a cannulated shaft, and a manifold assembly. The pump assembly includes a housing having a tapered surface configured to be at least partially received in an opening in the container, a pump at least partially disposed within the housing, a switch coupled to the housing, and circuitry at least partially disposed within the housing. The circuitry is configured to provide power to the pump for a predetermined amount of time upon activation of the switch. The cannulated shaft includes a first end configured to be removably coupled to housing and fluidly coupled to the pump. The manifold assembly includes a plenum, a manifold, and a ferrule. The ferrule is configured to fluidly couple the manifold assembly to a second end of the cannulated shaft. The aerator is further configured such that air flows from the pump assembly through the cannulated shaft, through an opening in the ferrule, and into the intake chamber defined by the manifold and the ferrule. Air within the intake chamber then flows through a plurality of openings arranged about a periphery of the manifold proximate to a top end of the manifold and partially defined by a bottom surface of the ferrule and into a plurality of intake runners to a plurality of radially arranged manifold nozzles configured to generate a plurality of air bubbles having a radial velocity configured to direct the plurality of air bubbles radially outward from the manifold assembly such that the plurality of air bubbles travel vertically upwards generally towards the opening of the container without generally contacting the main body portion of the container or the cannulated shaft. For example, the manifold assembly may be configured to generate the plurality of air bubbles having a radial velocity of 2.0 feet/second to 3.0 feet/second.

According to yet another aspect, the present disclosure features an aerator for aerating a liquid within a container having a main body portion and an opening. The aerator includes a pump assembly, a cannulated shaft, and a manifold assembly. The pump assembly includes a housing having a tapered surface configured to be at least partially received in an opening in the container, a pump at least partially disposed within the housing, and at least one air flute disposed within the tapered surface configured to allow air from the aerator to vent from inside the container. The cannulated shaft has a first end configured to be removably coupled to housing and fluidly coupled to the pump. The manifold assembly is configured to receive air from the pump assembly at an intake chamber and distribute the air to a plurality of radially arranged manifold nozzles configured to generate a plurality of air bubbles having a radial velocity configured to direct the plurality of air bubbles radially outward from the manifold assembly such that the plurality of air bubbles travel vertically upwards generally towards the opening of the container without generally contacting the main body portion of the container or the cannulated shaft. For example, the manifold assembly may be configured to generate the plurality of air bubbles having a radial velocity of 2.0 feet/second to 3.0 feet/second.

As used in any embodiment herein, "circuitry" may comprise, for example, singly or in any combination, hardwired circuitry, programmable circuitry, state machine circuitry, and/or firmware that stores instructions executed by programmable circuitry.

The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals. Likewise, the terms "connected" or "coupled" as used herein in regard to mechanical or physical connections or couplings is a relative term and does not require a direct physical connection.

The terms "first," "second," "third," and the like herein do not denote any order, quantity, or importance, but rather are used to distinguish one element from another, and the terms "a" and "an" herein do not denote a limitation of quantity, but rather denote the presence of at least one of the referenced item.

While the principles of the present disclosure have been described herein, it is to be understood by those skilled in the art that this description is made only by way of example and not as a limitation as to the scope of the invention. The features and aspects described with reference to particular embodiments disclosed herein are susceptible to combination and/or application with various other embodiments described herein. Such combinations and/or applications of such described features and aspects to such other embodiments are contemplated herein. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

What is claimed is:

1. An aerator for aerating a liquid within a container having a main body portion and an opening, said aerator comprising:

a pump assembly configured to provide an air flow;

a cannulated shaft; and a manifold assembly configured to be fluidly coupled to said pump assembly by way of said cannulated shaft, said manifold assembly defining a plurality of intake runners which extend from an intake chamber and terminate at a plurality of radially arranged manifold nozzles, wherein said radially arranged manifold nozzles are configured to generate a plurality of air bubbles directed generally radially outwardly from said manifold assembly.

2. The aerator of claim 1, wherein said manifold assembly is configured to generate said plurality of air bubbles having said radial velocity of 2.0 feet/second to 3.0 feet/second.

3. The aerator of claim 1, wherein said pump assembly further includes a light source configured to illuminate said liquid.

4. The aerator of claim 3, wherein said cannulated shaft is configured to extend generally parallel to, and an offset distance away, from a longitudinal axis of said pump assembly.

5. The aerator of claim 1, wherein said pump assembly further includes:

a pump;

a switch; and circuitry configured to provide power to said pump for a predetermined amount of time upon activation of said switch.

6. The aerator of claim 1, wherein said manifold assembly defines said intake chamber.

7. The aerator of claim 6, wherein said manifold assembly includes a plenum, a manifold, and a ferrule, wherein said ferrule is configured to be coupled to a distal end of said cannulated shaft and secure said manifold assembly to said cannulated shaft.

8. The aerator of claim 7, wherein air flows from said pump assembly through the cannulated shaft, through an opening in said ferrule, and into said intake chamber defined by said manifold and said ferrule, and wherein air within said intake chamber then flows through a plurality of openings arranged about a periphery of said manifold proximate to a top end of the manifold and partially defined by a bottom surface of said ferrule and into the plurality of intake runners.

9. The aerator of claim 7, wherein said ferrule comprises a shoulder region extending radially outward configured to engage with a shoulder region of said plenum, and wherein said manifold is configured to be coupled to said plenum and urge said shoulder region of ferrule against said shoulder region of said plenum to secure said ferrule within a cavity defined by said plenum and said manifold.

10. The aerator of claim 1, comprising at least two cannulated shafts configured to be removably coupled to said pump assembly, said two cannulated shafts having different lengths.

11. The aerator of claim 1, wherein said plurality of radially arranged manifold nozzles are configured to said plurality of air bubbles having a radial velocity configured to direct said plurality of air bubbles radially outward from said manifold assembly such that said plurality of air bubbles travel vertically upwards generally towards said opening of said container without generally contacting said main body portion of said container or said cannulated shaft.

12. An aerator for aerating a liquid within a container having a main body portion and an opening, said aerator comprising:

a pump assembly comprising:

a housing having a tapered surface configured to be at least partially received in said opening in said container;

a pump at least partially disposed within said housing;

a switch coupled to said housing; and circuitry at least partially disposed within said housing, said circuitry configured to provide power to said pump for a predetermined amount of time upon activation of said switch;

a cannulated shaft having a first end configured to be coupled to housing and fluidly coupled to said pump; and a manifold assembly comprising a plenum, a manifold, and a ferrule, said ferrule configured to fluidly couple said manifold assembly to a second end of said cannulated shaft;

wherein air flows from said pump assembly through the cannulated shaft, through an opening in said ferrule, and into an intake chamber defined by said manifold and said ferrule, and wherein air within said intake chamber then flows through a plurality of openings arranged about a periphery of said manifold proximate to a top end of the manifold and partially defined by a bottom surface of said ferrule and into a plurality of intake runners to a plurality of radially arranged manifold nozzles configured to generate a plurality of air bubbles directed generally radially outwardly from said manifold assembly.

13. The aerator of claim 12, wherein said manifold assembly is configured to generate said plurality of air bubbles having said radial velocity of 2.0 feet/second to 3.0 feet/second.

14. The aerator of claim 12, wherein said tapered surface further comprises an air flute configured to allow air from said aerator to vent from inside said container.

15. The aerator of claim 12, wherein said pump assembly further includes a light source configured to illuminate said liquid.

16. The aerator of claim 15, wherein said cannulated shaft is configured to extend generally parallel to, and an offset distance away, from a longitudinal axis of said housing.

17. The aerator of claim 12, comprising at least two cannulated shafts configured to be removably coupled to said pump assembly, said two cannulated shafts having different lengths.

18. The aerator of claim 12, wherein said plurality of radially arranged manifold nozzles are configured to said plurality of air bubbles having a radial velocity configured to direct said plurality of air bubbles radially outward from said manifold assembly such that said plurality of air bubbles travel vertically upwards generally towards said opening of said container without generally contacting said main body portion of said container or said cannulated shaft.

19. An aerator for aerating a liquid within a container having a main body portion and an opening, said aerator comprising:

a pump assembly comprising:

a housing having a tapered surface configured to be at least partially received in an opening in said container;

a pump at least partially disposed within said housing; and at least one air flute configured to allow air from said aerator to vent from inside said container;

a cannulated shaft having a first end configured to be coupled to housing and fluidly coupled to said pump; and a manifold assembly configured to receive air from said pump assembly at an intake chamber, said manifold assembly defining a plurality of intake runners which extend from an intake chamber and terminate at a plurality of radially arranged manifold nozzles configured to generate a plurality of air bubbles directed generally radially outwardly from said manifold assembly.

20. The aerator of claim 19, wherein said manifold assembly is configured to generate said plurality of air bubbles having said radial velocity of 2.0 feet/second to 3.0 feet/second.

* * * * *